US009141060B2

(12) United States Patent
Takemura

(10) Patent No.: US 9,141,060 B2
(45) Date of Patent: Sep. 22, 2015

(54) IMAGE FORMING APPARATUS

(71) Applicant: CANON KABUSHIKI KAISHA, Tokyo (JP)

(72) Inventor: Taichi Takemura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/197,008

(22) Filed: Mar. 4, 2014

(65) Prior Publication Data

US 2014/0255046 A1 Sep. 11, 2014

(30) Foreign Application Priority Data

Mar. 5, 2013 (JP) ..... 2013-043233

(51) Int. Cl.
*G03G 15/00* (2006.01)

(52) U.S. Cl.
CPC ..... *G03G 15/5062* (2013.01)

(58) Field of Classification Search
CPC ..... G03G 15/5041; G03G 15/6573; G03G 15/6585; G03G 15/6579; G03G 15/5054–15/5062; G03G 2215/00029–2215/00042; G03G 2215/00569
See application file for complete search history.

(56) References Cited

U.S. PATENT DOCUMENTS

| | | | | |
|---|---|---|---|---|
| 8,909,072 | B2 * | 12/2014 | Takemura | 399/15 |
| 2007/0134010 | A1 * | 6/2007 | Yokoyama | 399/39 |
| 2008/0013970 | A1 * | 1/2008 | Kikuchi | 399/45 |
| 2009/0016749 | A1 * | 1/2009 | Mashiba | 399/39 |
| 2010/0329756 | A1 * | 12/2010 | Mizes | 399/364 |
| 2011/0058823 | A1 * | 3/2011 | Hirai | 399/15 |
| 2012/0092687 | A1 * | 4/2012 | Hirai | 358/1.9 |
| 2013/0136474 | A1 * | 5/2013 | Itagaki | 399/49 |
| 2013/0156445 | A1 * | 6/2013 | Takemura | 399/15 |
| 2014/0125982 | A1 * | 5/2014 | Takemura | 356/421 |
| 2014/0133875 | A1 * | 5/2014 | Harashima et al. | 399/49 |
| 2014/0185114 | A1 * | 7/2014 | Takemura | 358/504 |
| 2014/0226192 | A1 * | 8/2014 | Takemura | 358/504 |
| 2014/0233049 | A1 * | 8/2014 | Takemura | 358/1.12 |

FOREIGN PATENT DOCUMENTS

| | | | | |
|---|---|---|---|---|
| JP | 2003287934 A | * | 10/2003 | G03G 15/00 |
| JP | 2004-163216 A | | 6/2004 | |
| JP | 2006-58565 A | | 3/2006 | |
| JP | 2008008967 A | * | 1/2008 | |

* cited by examiner

*Primary Examiner* — Clayton E Laballe
*Assistant Examiner* — Ruifeng Pu
(74) *Attorney, Agent, or Firm* — Canon USA, Inc. IP Division

(57) ABSTRACT

An image forming apparatus includes an image forming unit configured to form a measurement image on a sheet along a main scanning direction, a fixing unit configured to fix the measurement image onto the sheet, a first calculation unit configured to cause a measuring unit to output a measured value at a predetermined point of measurement on the measurement image, a feeding unit to rotate the sheet 90 degrees and feed the sheet, the sheet to pass through the fixing unit again, and the measuring unit to output measured values at a plurality of points of measurement, and calculate a first correction coefficient from first and second measured values at the point of measurement, a correction unit configured to correct the measured values with the first correction coefficient, and a second calculation unit configured to calculate a second correction coefficient for correcting an unevenness in the main scanning direction.

18 Claims, 18 Drawing Sheets

FIG. 19

| DENSITY VALUES OF SECOND FIXING PROCESS | | DENSITY VALUES OF FIRST FIXING PROCESS |
|---|---|---|
| 0.454 | | 0.544 |
| 0.682 | | 0.756 |
| 0.886 | | 0.943 |
| 1.068 | CONVERT → | 1.105 |
| 1.226 | | 1.243 |
| 1.361 | | 1.356 |
| 1.473 | | 1.445 |
| 1.561 | | 1.508 |
| 1.627 | | 1.548 |
| 1.669 | | 1.562 |

IMAGE FORMING APPARATUS

BACKGROUND OF THE INVENTION

1. Field of the Invention

The present invention relates to an image forming apparatus capable of correcting unevenness of an image in a main scanning direction.

2. Description of the Related Art

An image forming apparatus may provide various image qualities such as grainness, uniformity in a plane, character quality, and reproducibility (including color stability). Such image qualities provided by an electrophotography image forming apparatus may be influenced by uneven electrification caused by degradation of a charger which electrostatically charges a photosensitive drum, uneven exposure of a laser scanner, for example, configured to form an electrostatic latent image on a photosensitive drum, uneven development by a developing device which develops an electrostatic latent image or the like.

These unevennesses may cause uneven density and/or uneven color in a main scanning direction (orthogonal to a sheet conveying direction for forming an image on a sheet), which may disadvantageously deteriorate uniformity in a plane.

Japanese Patent Laid-Open No. 2004-163216 proposes a technology (main-scanning shading correction) of outputting a sheet on which a plurality of test patterns are printed in a main scanning direction and measuring color densities of the test patterns with a handy densitometer, for example, to correct an uneven density in the main scanning direction.

On the other hand, Japanese Patent Laid-Open No. 2006-58565 discloses a method of performing such main-scanning shading correction by using a color sensor internally mounted in an image forming apparatus.

Japanese Patent Laid-Open No. 2006-58565 discloses a technology of forming a band-shaped test pattern based on an equal image signal value in a main scanning direction of a sheet. Japanese Patent Laid-Open No. 2006-58565 further discloses a technology of rotating a sheet having a test pattern 90 degrees, setting it to a feeding unit, refeeding the sheet, and measuring the test pattern by using a color sensor within an image forming apparatus.

However, the disclosure in Japanese Patent Laid-Open No. 2006-58565 measures a test pattern after the sheet having the test pattern passes through a fixing unit twice since the sheet is rotated 90 degrees is refed to measure the test pattern with a color sensor. This may cause an error in measured value because the color value and color density value of the test pattern may change through the two fixing steps.

A special conveying path may be provided to prevent a test pattern from passing through a fixing unit twice, which however may increase the size of the image forming apparatus.

SUMMARY OF THE INVENTION

According to an aspect of the present invention, there is provided an image forming apparatus including a conveying unit configured to convey a sheet, an image forming unit configured to form a measurement image on a sheet along a main scanning direction orthogonal to a sheet conveying direction of the conveying unit, a fixing unit configured to fix the measurement image formed by the image forming unit onto the sheet by heating, a measuring unit configured to irradiate light to the measurement image on the sheet having passed through the fixing unit, measuring reflected light from the measurement image, and outputting a measured value, an discharging unit configured to discharge a sheet measured by the measuring unit, a feeding unit configured to rotate the direction of a sheet discharged by the discharging unit once such that the measurement image formed along the main scanning direction may be along the sheet conveying direction, a first calculation unit configured to cause the measuring unit to output a measured value at a predetermined point of measurement on the measurement image after the sheet passes through the fixing unit, cause the feeding unit to feed the sheet, causing the sheet to pass through the fixing unit again, cause the measuring unit to output measured values at a plurality of points of measurement including the measured value at the point of measurement, and calculate a first correction coefficient from a first measured value and a second measured value at the point of measurement, a correction unit configured to correct the measured values at the plurality of points of measurement by using the first correction coefficient calculated by the first calculation unit, and a second calculation unit configured to calculate a second correction coefficient for correcting an unevenness in the main scanning direction on basis of the measured value at the plurality of points of measurement corrected by the correction unit.

The present invention may correct an unevenness with high accuracy in a main scanning direction of an image to be formed without increasing the size of an image forming apparatus.

Further features of the present invention will become apparent from the following description of exemplary embodiments with reference to the attached drawings.

BRIEF DESCRIPTION OF THE DRAWINGS

FIG. 19 is a conversion table according to a second embodiment.

DESCRIPTION OF THE EMBODIMENTS

First Embodiment

Image Forming Apparatus

According to a first embodiment, an electrophotography laser beam printer is applied. For example, electrophotography is adopted as an image formation method. However, the present invention is applicable to an ink-jet method or a dye sublimation method.

Figure 1:
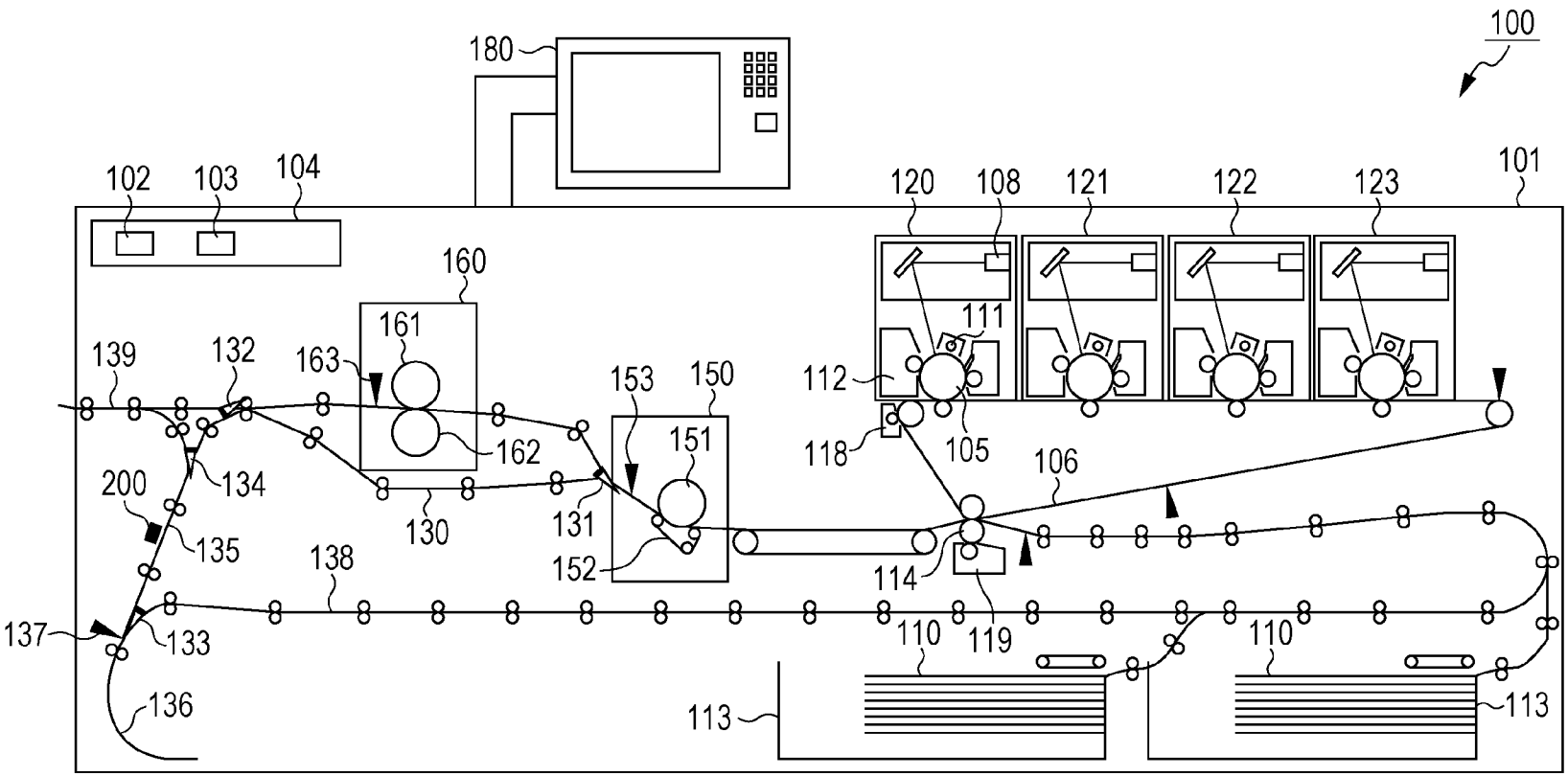
FIG. 1 is a section view illustrating a structure of an image forming apparatus.

FIG. 1 is a section view illustrating a structure of an image forming apparatus 100. The image forming apparatus 100 includes a housing 101. The housing 101 contains mechanisms that configure an engine unit and a control board container 104. The control board container 104 contains an engine control unit 102 configured to perform control relating to printing processes (such as a feeding process) by the mechanisms and a printer controller 103.

As illustrated in FIG. 1, the engine unit includes four YMCK stations 120, 121, 122, and 123. The station 120, 121, 122, and 123 are image forming units configured to transfer toners to a sheet 110 to form an image. Here, YMCK stands for yellow, magenta, cyan, and black. Each of the stations includes substantially common components. A photosensitive drum 105 is a type of image-bearing member, and a primary charger 111 electrostatically charges to uniform surface potentials. On the photosensitive drum 105, an electrostatic latent image is formed by a laser beam output by a laser 108. The amount of laser exposure for the tone of each pixel may be changed by pulse width modulation (PWM).

A developing device 112 uses a coloring material (toner) to develop a latent image to form a toner image. The toner image (visible image) is transferred onto an intermediate transfer member 106. The visible image formed on the intermediate transfer member 106 is transferred by a transfer roller 114 to a sheet 110 conveyed from the container 113. The intermediate transfer member 106 and transfer roller 114 are abutted against cleaning mechanisms 118 and 119 capable of removing toner adhered to the intermediate transfer member 106 and transfer roller 114.

A fixing mechanism according to this embodiment includes a first fixing unit 150 and a second fixing unit 160 configured to heat and press a toner image transferred onto the sheet 110 to fix it to the sheet 110. The first fixing unit 150 includes a fixing roller 151 configured to heat a sheet 110, a pressing belt 152 configured to press a sheet 110 to the fixing roller 151, and a first post-fixing sensor 153 configured to detect a completion of fixing. The fixing roller 151 is a hollow roller and internally has a heater.

A second fixing unit 160 is disposed downstream of the first fixing unit 150 in the sheet conveying direction. The second fixing unit 160 may gloss and provides fixability to a toner image on a sheet which is fixed by the first fixing unit 150. Like the first fixing unit 150, the second fixing unit 160 includes a fixing roller 161, a pressing roller 162, and a second post-fixing sensor 163. Some types of sheet 110 do not require passage through the second fixing unit 160. In this case, a sheet 110 passes through a conveying path 130 without through the second fixing unit 160 for reduction of energy consumption.

For example, when high glossing on an image on a sheet 110 is set or when a large amount of heat is required for fixing on a sheet 110 like a case where the sheet 110 is thick paper, the sheet 110 having passed through the first fixing unit 150 is further conveyed to the second fixing unit 160. On the other hand, in a case where the sheet 110 is plain paper or thin paper but high glossing is not set, the sheet 110 is conveyed through a conveying path 130 that detours the second fixing unit 160. The switching member 131 is usable for controlling whether the sheet 110 is to be conveyed to the second fixing unit 160 or the sheet 110 is to be conveyed by detouring the second fixing unit 160.

A discharged-paper conveying path 139 is a conveying path for discharging a sheet 110 externally. The switching member 132 is usable for controlling whether the sheet 110 is to be guided to the conveying path 135 or to the discharged-paper conveying path 139. A leading end of the sheet 110 guided to the conveying path 135 passes through a reverse sensor 137 and is conveyed to a reverse unit 136. If the reverse sensor 137 detects a trailing end of the sheet 110, the conveying direction of the sheet 110 is changed. The switching member 133 is usable for controlling whether the sheet 110 is to be guided to a conveying path 138 for double-sided image formation or to the conveying path 135.

A color sensor 200 configured to detect a patch image on a sheet 110 is disposed on the conveying path 135. The color sensor 200 includes four sensors 200*a* to 200*d* aligned in the direction orthogonal to the conveying direction of the sheet 110 and capable of detecting four patch image lines. If a measurement is instructed through an operating unit 180, the engine control unit 102 executes main-scanning shading correction, maximum density adjustment, tone adjustment, multinary color correction processes and/or the like. Notably, a density adjustment or tone adjustment process measures a color density of a monochromatic measurement image. A multinary color correction process measures color of a measurement image on which a plurality of colors are overlapped.

A switching member 134 is a guiding member configured to guide a sheet 110 to the discharged-paper conveying path 139. A sheet 110 conveyed through the discharged-paper conveying path 139 is discharged externally to the image forming apparatus 100.

Color Sensor

Figure 2:
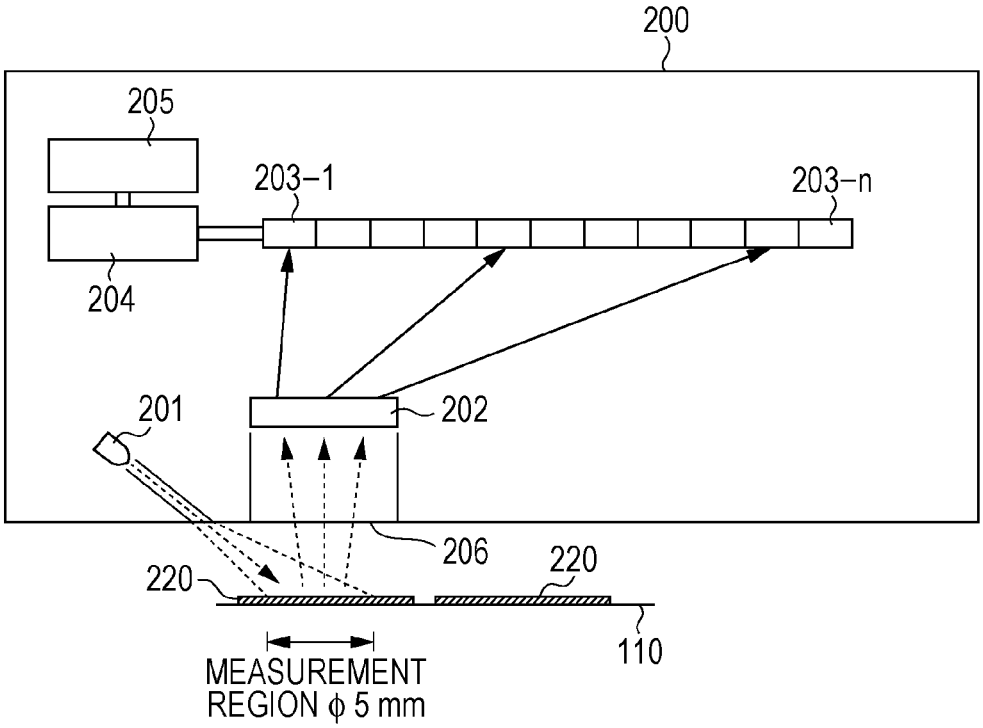
FIG. 2 illustrates a color sensor.

FIG. 2 illustrates a structure of the color sensor 200. The color sensor 200 internally contains a white LED 201, a diffraction grating 202, a line sensor 203, a computing unit 204, and a memory 205. The white LED 201 is a light emitting device configured to radiate light to a patch image 220 on a sheet 110. The light reflected from the patch image 220 passes through a window 206 configured by a transparent member.

The diffraction grating 202 disperses reflected light from the patch image 220 for each wavelength. The line sensor 203 is a photodetecting element including n light receiving elements configured to detect the light dispersed for each wavelength by the diffraction grating 202. The computing unit 204 computes on basis of light intensity values of pixels detected by the line sensor 203.

The memory 205 stores data to be used by the computing unit 204. The computing unit 204 may have a spectral computing unit configured to compute a spectral reflectivity from a light intensity value. A lens may further be provided which converges light radiated from the white LED 201 onto the patch image 220 on the sheet 110 or converges light reflected from the patch image 220 to the diffraction grating 202. A measurement region for measuring a patch image on a sheet 110 with the color sensor 200 is equal to an area irradiated by the white LED 201 (spot diameter) and is equal to ϕ5 mm according to this embodiment.

Figure 3:
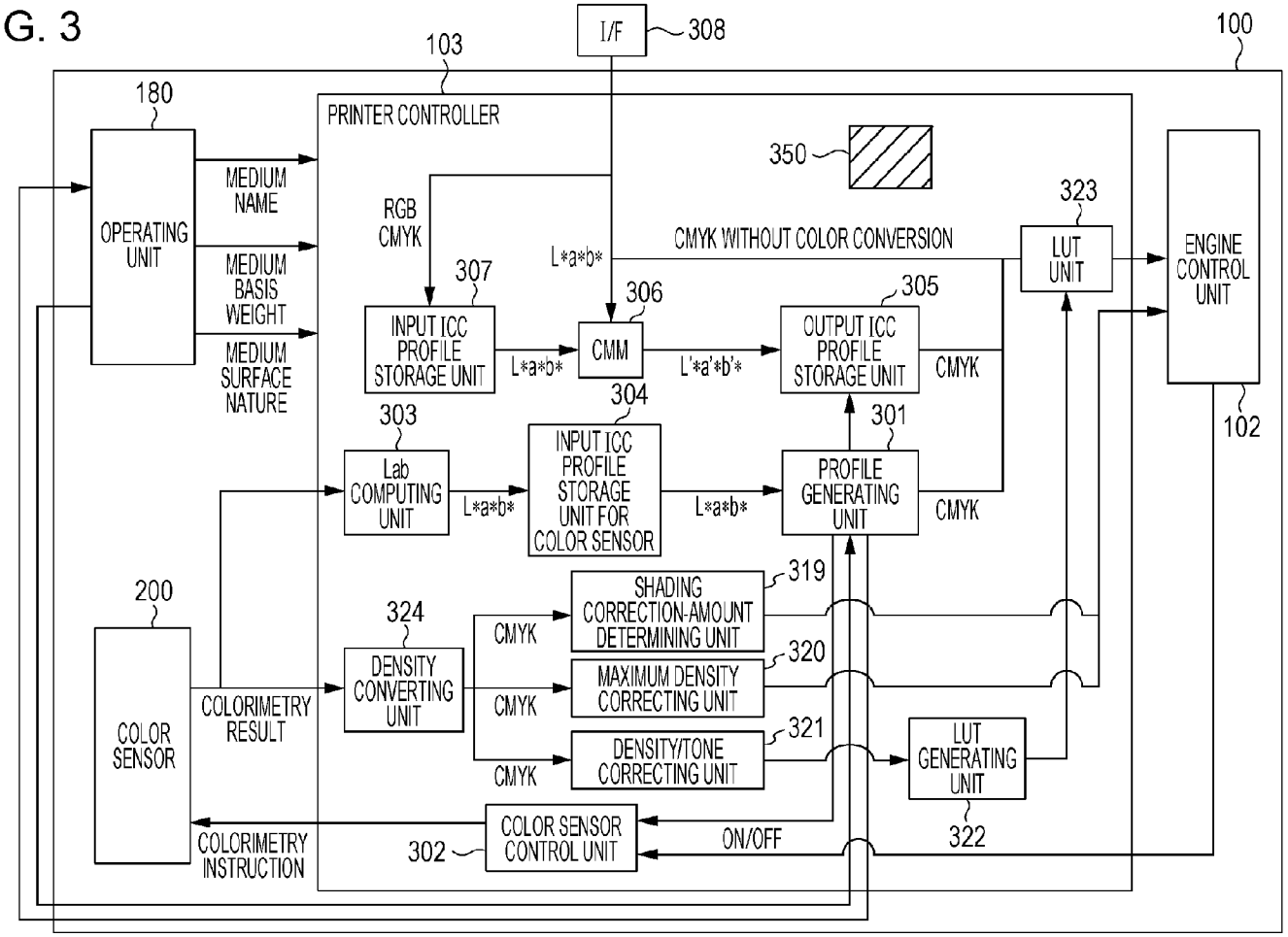
FIG. 3 is a block diagram illustrating a system configuration of an image forming apparatus.

FIG. 3 is a block diagram illustrating a system configuration of the image forming apparatus 100. With reference to FIG. 3, maximum density adjustment, tone adjustment, and multinary color correction processes will be described. For easy understanding of the processes to be performed by the printer controller 103, FIG. 3 illustrates internal components of the printer controller 103.

Maximum Density Adjustment First, the printer controller 103 instructs the engine control unit 102 to output a test chart to be used for a maximum-density adjustment. In this case, CMYK patch images for maximum-density adjustment are formed on a sheet 110 with the charged potential, exposure intensity, and development bias that are preset or set in the last maximum-density adjustment. After that, the engine control unit 102 instructs the color sensor control unit 302 to measure the patch images.

After the color sensor 200 measures the patch images, the measured results are transmitted to a density conversion unit 324 as spectral reflectivity data. The density conversion unit 324 converts the spectral reflectivity data to CMYK color density data and transmits the converted color density data to the maximum-density correction unit 320.

The maximum-density correction unit 320 calculates correction amounts for the charged potential, exposure intensity, and development bias such that the color density output when image data having a maximum density is toner image may have a desirable value and transmits the calculated correction amounts to the engine control unit 102. The engine control unit 102 uses the correction amounts for the transmitted charged potential, exposure intensity, and development bias in subsequent image formation operations. The operation described above may adjust the maximum density of an image to be output.

Tone Adjustment

After a maximum-density adjustment process ends, the printer controller 103 instructs the engine control unit 102 to form patch images having 16 tones on a sheet 110. The image signals of the patch images having 16 tones may be referred by 00H, 10H, 20H, 30H, 40H, 50H, 60H, 70H, 80H, 90H, A0H, B0H, C0H, D0H, E0H, and FFH, for example.

In this case, the correction amounts for the charged potential, exposure intensity, and development bias calculated in the maximum-density adjustment are used for forming CMYK patch images for 16 tones on a sheet 110. After the patch images for 16 tones are formed on a sheet 110, the engine control unit 102 instructs the color sensor control unit 302 to measure the patch images.

After the color sensor 200 measures the patch images, the measurement results are transmitted to the density conversion unit 324 as spectral reflectivity data. The density conversion unit 324 converts the spectral reflectivity data to CMYK color density data and transmits the converted color density data to a color density/tone correction unit 321. The color density/tone correction unit 321 calculates a correction amount for the amount of exposure to acquire a desirable tonality. An LUT generating unit 322 generates a monochromatic tone LUT and transmits it to an LUT unit 323 as CMYK signal values.

Profile

In order to perform a multinary color adjustment process, the image forming apparatus 100 generates an ICC profile, which will be described below, from measurement results from patch images including multinary color and uses the profile to convert an input image and form an output image.

Figure 4:
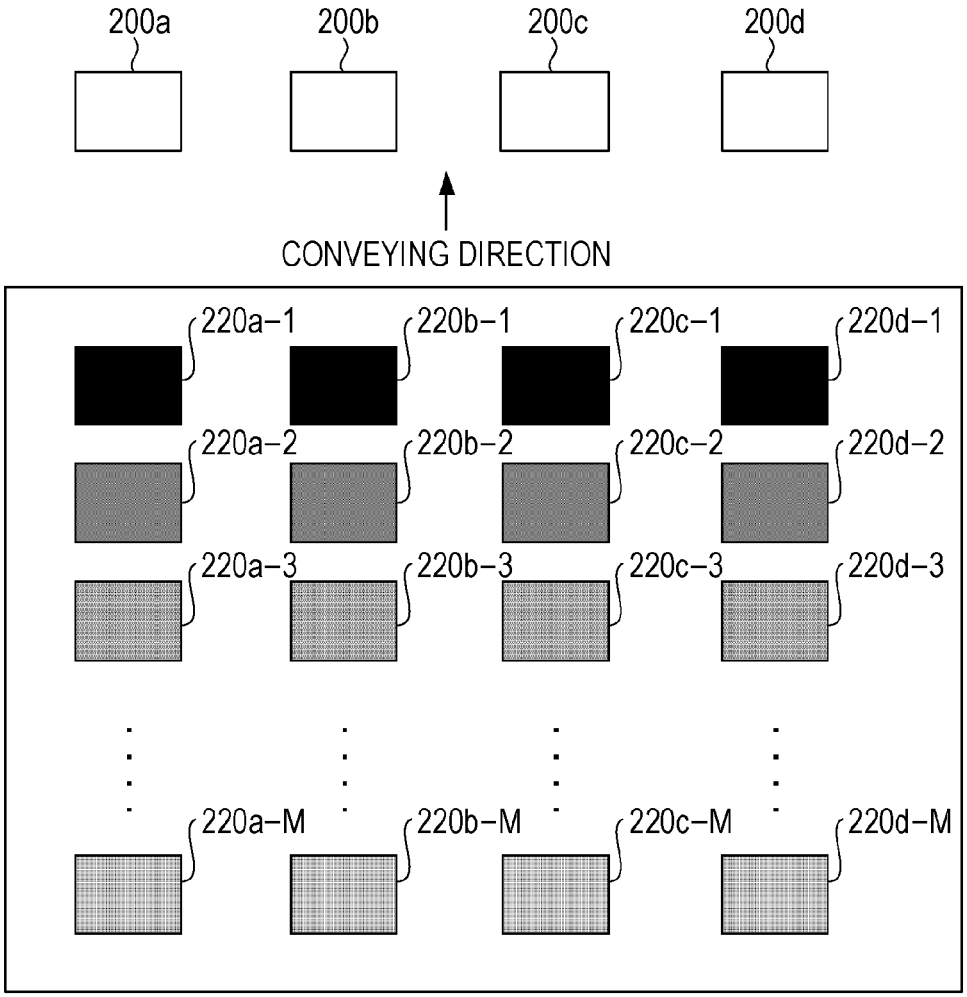
FIG. 4 is a conceptual diagram illustrating a color measurement chart.

The halftone area ratios of the patch image 220 including multinary color are changed to three levels (0%, 50%, 100%) for each of the four CMYK colors to form patch images having all combinations of the halftone area ratios. The patch images 220 are formed in four lines to be read by the color sensors 200*a* to 200*d* as illustrated in FIG. 4.

An ICC profile having been accepted by the market in recent years is used here as a profile that may provide high reproducibility. However, the present invention is applicable without an ICC profile. The present invention is applicable to Color Rendering Dictionary (CRD) adopted from Level 2 of PostScript proposed by Adobe, a color separation table within Photoshop (registered trademark) and so on.

For component replacement by a customer engineer, before a job requiring color matching accuracy or to identify the hue of a final output matter during a designing stage, a user may operate the operating unit 180 to instruct to generate a color profile.

The profile generation processing is performed by the printer controller 103 illustrated in the block diagram in FIG. 3. The printer controller 103 has a CPU configured to read and execute a program for executing processing on a flowchart, which will be described below, from the storage unit 350.

When the operating unit 180 receives the profile generation instruction, a profile generation unit 301 outputs a CMYK color chart 210 that is an ISO12642 test form to the engine control unit 102 without through a profile. The profile generation unit 301 transmits a measurement instruction to the color sensor control unit 302. The engine control unit 102 controls the image forming apparatus 100 to execute a charging, exposure, development, transfer, fixing processes or the like. Thus, the ISO12642 test form is formed on the sheet 110.

The color sensor control unit 302 controls the color sensor 200 to measure the ISO12642 test form. The color sensor 200 outputs spectral reflectivity data that is a measurement result to a Lab computing unit 303 in the printer controller 103. The Lab computing unit 303 converts the spectral reflectivity data to color value data (L*a*b* data) and outputs it to the profile generation unit 301. In this case, the L*a*b* data output from the Lab computing unit 303 is converted by using color-sensor input ICC profile stored in a color-sensor input ICC profile storage unit 304. The Lab computing unit 303 may convert spectral reflectivity data to a CIE1931XYZ color specification system that is a device-independent color space signal.

The profile generation unit 301 generates an output ICC profile from a relationship between a CMYK color signal output to the engine control unit 102 and L*a*b* data converted by using the color-sensor input ICC profile. The profile generation unit 301 stores the generated output ICC profile in an output-ICC-profile storage unit 305.

An ISO12642 test form includes a patch of a CMYK color signal that covers a color gamut that can be output by a general copier. Therefore, the profile generation unit 301 generates a color conversion table from a relationship between individual color signal values and measured L*a*b* values. In other words, a CMYK→Lab conversion table is generated. An inverse conversion table is generated on basis of the conversion table.

In response to a profile creation instruction from a host computer through an I/F 308, the profile generation unit 301 outputs the generated output ICC profile through the I/F 308. The host computer is capable of executing a color conversion corresponding to an ICC profile with an application program.

Color Conversion Process

In a color conversion to a normal color output, RGB signal values input from a scanner unit through the I/F 308 or an image signal input by assuming standard print CMYK signal values of JapanColor, for example, are transmitted to an input-ICC profile storage unit 307 for external input. The input-ICC profile storage unit 307 executes RGB→Lab or CMYK→Lab conversion in accordance with the image signal input from the I/F 308. An input ICC profile stored in the input-ICC profile storage unit 307 includes a plurality of look-up tables (LUTs).

Those LUTs may include a one-dimensional LUT for controlling gamma of an input signal, a multinary color LUT called a direct mapping, and a one-dimensional LUT for controlling gamma of generated conversion data. These tables are used to convert an input image signal from a device dependent color space to a device-independent L*a*b* data.

An image signal converted to L*a*b* coordinates is input to a color management module (CMM) 306. The CMM 306 executes a color conversion. For example, the CMM 306 may execute GAMUT conversion that maps a mismatch between a reading color space of an input apparatus such as a scanner unit, for example, and an output-color reproducible range of an output apparatus such as the image forming apparatus 100. The CMM 306 may further execute a color conversion that adjusts a mismatch between the type of a light source for inputting and the type of a light source for observing an output matter (which may be called a mismatch of color temperature settings).

Through this operation, the CMM 306 converts L*a*b* data to L'*a'*b'* data to the output-ICC-profile storage unit 305. A profile generated on basis of a measurement result is stored in the output-ICC-profile storage unit 305. Thus, the output-ICC-profile storage unit 305 executes color conversion of the L'*a'*b'* data with the newly generated ICC profile to a CMYK signal dependent on the output apparatus and outputs it to the engine control unit 102.

Figure 5:
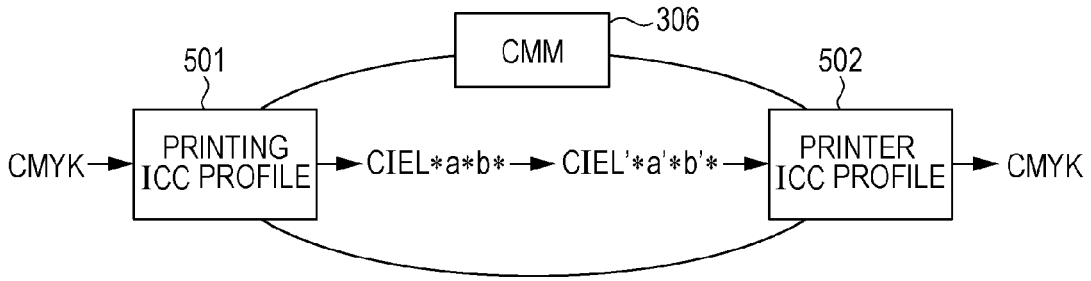
FIG. 5 is a schematic diagram of a color management environment.

Referring to FIG. 3, the CMM 306 is separated from the input-ICC profile storage unit 307 and the output-ICC-profile storage unit 305. However, as illustrated in FIG. 5, the CMM 306 is a module responsible for color management and thus performs color conversion by using an input profile (printing ICC profile 501) and an output profile (printer ICC profile 502).

A shading correction-amount determining unit 319 determines a correction amount in a main-scanning shading mode. The main-scanning shading mode will be described in detail below.

Operating Unit

Figure 6:
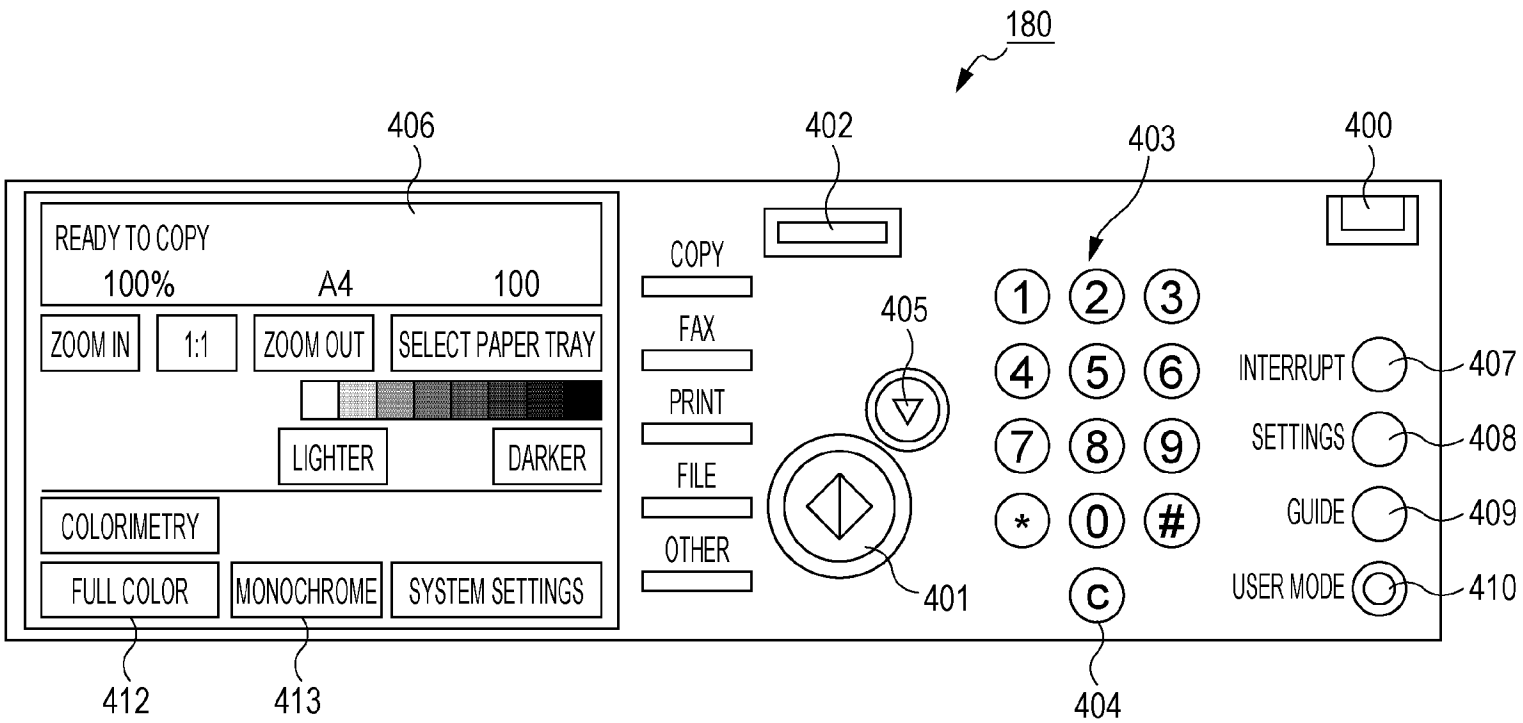
FIG. 6 illustrates an operating unit.

FIG. 6 illustrates the operating unit 180. The operating unit 180 includes a soft switch 400 usable for turning on/off a power source of the image forming apparatus 100, a copy start key 401 usable for instructing a copy start, and a reset key 402 usable for returning to a standard mode. The standard mode is set in "full-color/single side" here, for example.

The operating unit 180 further includes a key pad 403 usable for inputting a numerical value such as a set number of copies, a clear key 404 usable for cancelling the numerical value, and a stop key 405 usable for stopping a continuous copy operation.

A touch panel display 406 is provided on the left side of the operating unit 180 and may display mode settings and a printer status. The operating unit 180 further has, at its right end, an interruption key 407 usable for interrupting an image formation operation for copying, a password key 408 usable for managing the number of copies allocated personally or to a department, and a guidance key 409 to be pressed for using a guidance function.

A user mode key 410 is provided under these keys. The user mode key 410 is usable for entering a user mode in which a user may manage the image forming apparatus 100 and alter settings therein, including designation of a calibration mode, designation of a main-scanning shading mode, and registration of sheet information.

The touch panel display 406 has a full-color image formation mode select key 412, and monochromatic-image formation mode select key 413.

Calibration Mode

Figure 7:
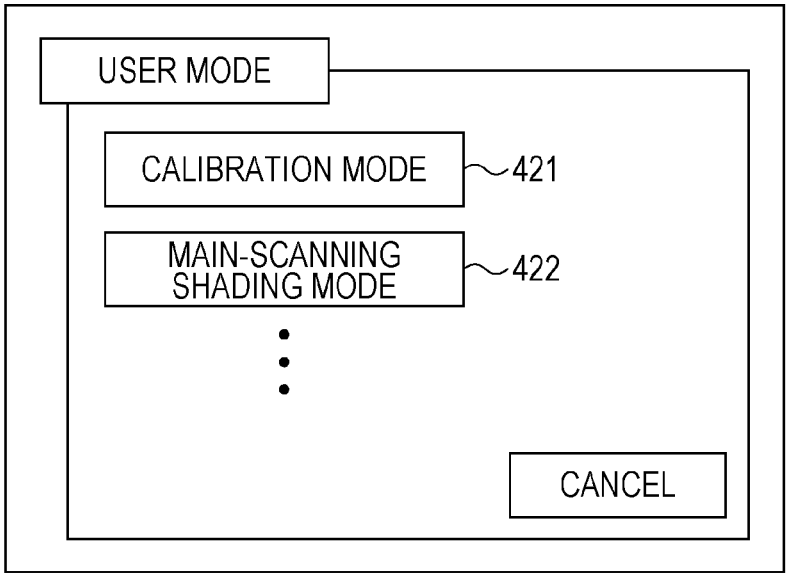
FIG. 7 illustrates a display screen when a user mode key is selected.

Next, a calibration mode according to this embodiment will be described. First, in the operating unit 180 illustrated in FIG. 6, when the user mode key 410 is selected by a user, a screen illustrated in FIG. 7 is displayed on the touch panel display 406.

A calibration mode key 421 is usable for instructing execution of a calibration for improving the color density and color stability of an image. A main-scanning shading mode key 422 is usable for instructing execution of a main-scanning shading correction that corrects an uneven density and/or an uneven color in a main scanning direction (orthogonal to a sheet conveying direction) of an image to be formed on a sheet 110.

It should be noted that the term "calibration" here refers to the aforementioned maximum-density adjustment, tone adjustment, and/or multinary color correction processing. When the calibration mode key 421 is selected, a calibration operation is started. A series of steps of the calibration will be described with reference to flowcharts.

Figure 8:
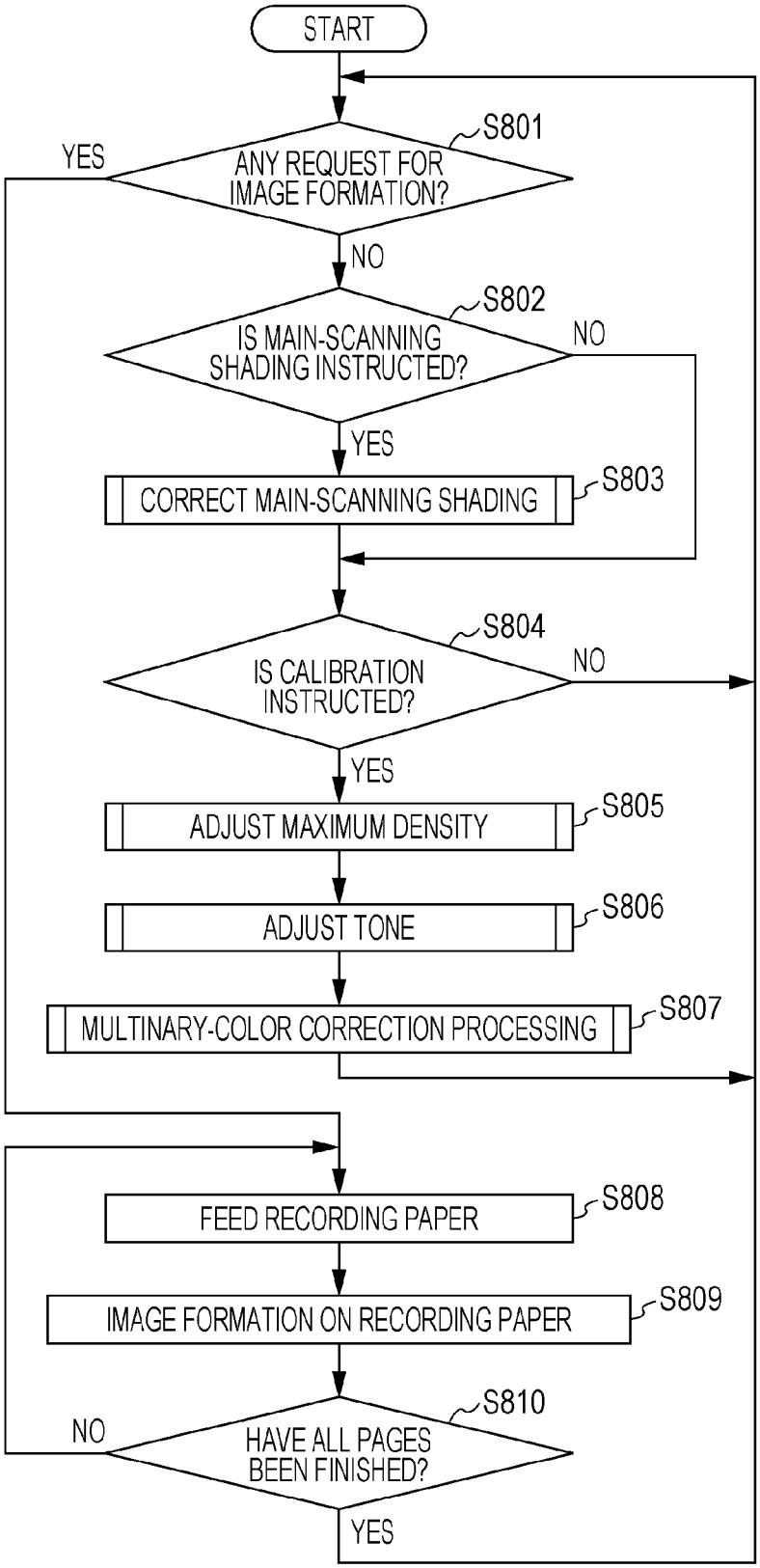
FIG. 8 is a flowchart illustrating an operation of an image forming apparatus.

FIG. 8 is a flowchart illustrating an operation of the image forming apparatus 100. The operation on the flowchart is executed by the printer controller 103. The printer controller 103 first determines whether any request for image formation has been received from the operating unit 180 or not and whether any request for image formation has been received from a host computer through the I/F 308 (S801).

If no request for image formation has been received, the printer controller 103 determines whether main-scanning shading is instructed from the operating unit 180 or not (S802). Main-scanning shading may be instructed by selecting the main-scanning shading mode key 422 as described above. If main-scanning shading is instructed, a main-scanning shading correction (S803) is performed, which will be described below with reference to FIG. 12.

Next, the printer controller 103 determines whether a calibration is instructed by the operating unit 180 or not (S804). A calibration may be instructed in response to selection of the calibration mode key 421 as described above.

Figure 9:
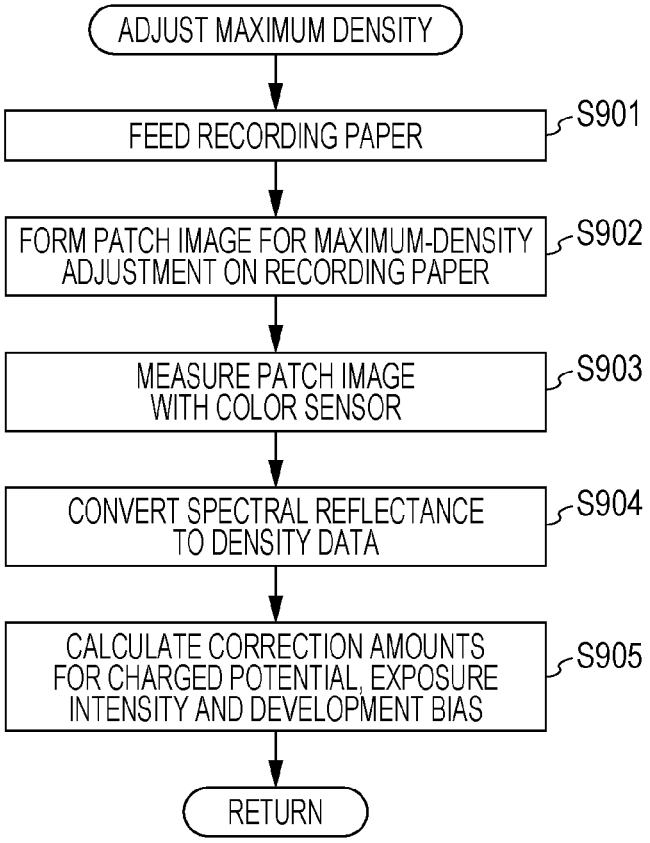
FIG. 9 is a flowchart illustrating an operation for adjusting a maximum density.
Figure 10:
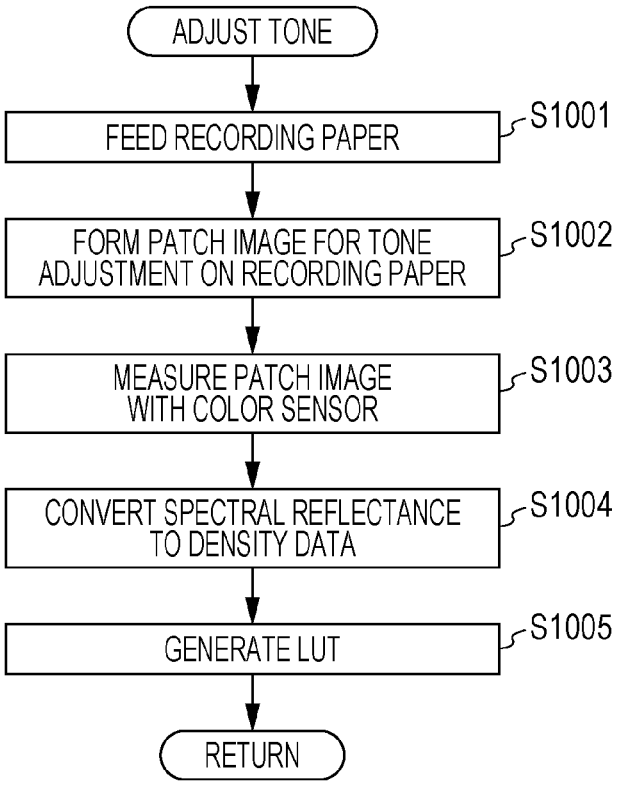
FIG. 10 is a flowchart illustrating an operation for adjusting a tone.
Figure 11:
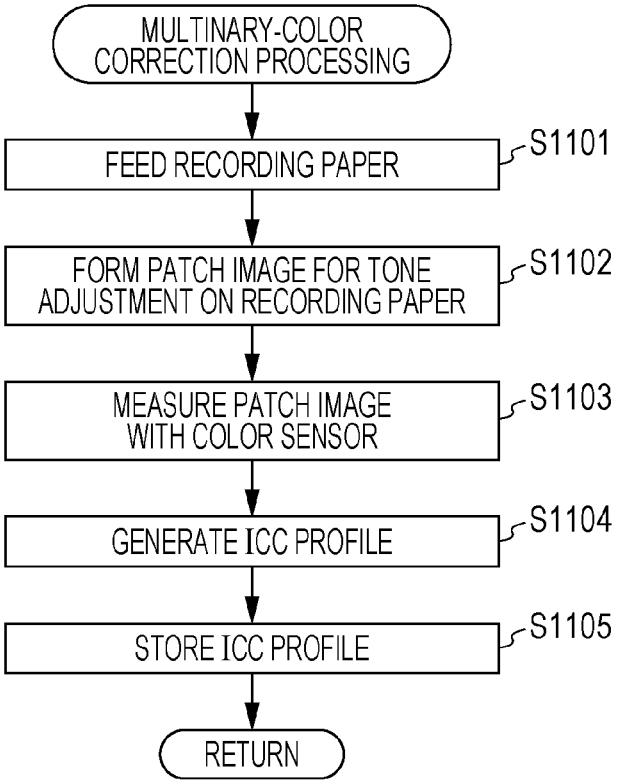
FIG. 11 is a flowchart illustrating an operation of multinary color correction processing.

If a calibration is instructed, a maximum-density adjustment (S805), which will be described below with reference to FIG. 9, is performed, and a tone adjustment (S806), which will be described below with reference to FIG. 10, is performed. After that, a multinary color correction process (S807), which will be described with reference to FIG. 11, is performed. In step S804, if a calibration is not instructed, the processing returns to step S801. A maximum-density adjustment and a tone adjustment are performed before a multinary color correction is performed to perform the multinary color correction process with high accuracy.

In step S801, if it is determined that any request for image formation has been received, the printer controller 103 instructs the engine control unit 102 to feed a sheet 110 from the container 113 (S808). After that, the printer controller 103 instructs the engine control unit 102 to form a toner image on the sheet 110 (S809).

The printer controller 103 then determines whether image formation on all pages has ended or not (S810). If image formation on all pages has ended, the processing returns to step S801. If not, the processing returns to step S808, and image formation is performed on the next page.

FIG. 9 is a flowchart illustrating an operation of a maximum-density adjustment. The processing on the flowchart is executed by the printer controller 103. The image forming apparatus 100 is controlled by the engine control unit 102 in response to an instruction from the printer controller 103.

First, the printer controller 103 instructs the engine control unit 102 to feed a sheet 110 from the container 113 (S901) and to form a patch image for maximum-density adjustment on the sheet 110 (S902). Next, when the sheet 110 reaches the color sensor 200, the printer controller 103 causes the color sensor 200 to measure the patch image (S903).

The printer controller 103 uses the density conversion unit 324 to convert spectral reflectivity data output from the color sensor 200 to CMYK color density data (S904). After that, the printer controller 103 calculates correction amounts for charged potential, exposure intensity, and development bias on basis of the converted color density data (S905). The correction amounts calculated here are stored in the storage unit 350.

FIG. 10 is a flowchart illustrating an operation of a tone adjustment. The processing on the flowchart is executed by the printer controller 103. The image forming apparatus 100 is controlled by the engine control unit 102 in response to an instruction from the printer controller 103.

First, the printer controller 103 instructs the engine control unit 102 to feed a sheet 110 from the container 113 (S1001) and to form a patch image for tone adjustment (16 tones) on the sheet 110 (S1002). Next, when the sheet 110 reaches the color sensor 200, the printer controller 103 causes the color sensor 200 to measure the patch image (S1003).

The printer controller 103 uses the density conversion unit 324 to convert spectral reflectivity data output from the color sensor 200 to CMYK color density data (S1004). After that, the printer controller 103 calculates correction amounts for exposure intensity on basis of the converted color density data to generate an LUT for tone correction (S1005). The LUT generated here is set in the LUT unit 323 for use.

FIG. 11 is a flowchart illustrating an operation of a multinary color correction process. The processing on the flowchart is executed by the printer controller 103. The image forming apparatus 100 is controlled by the engine control unit 102 in response to an instruction from the printer controller 103.

First, the printer controller 103 instructs the engine control unit 102 to feed a sheet 110 from the container 113 (S1101) and to form a patch image for multinary color correction process on the sheet 110 (S1102). Next, when the sheet 110 reaches the color sensor 200, the printer controller 103 causes the color sensor 200 to measure the patch image (S1103).

The printer controller 103 uses the Lab computing unit 303 to calculate color value data (L*a*b*) from spectral reflectivity data output from the color sensor 200. The printer controller 103 generates an ICC profile by the processing above on basis of the color value data (L*a*b*) (S1104) and stores it in the output-ICC-profile storage unit 305 (S1105).

Performing the series of calibrations including a maximum-density adjustment, a tone adjustment, and a multinary color correction process may provide stable color density/tone/hue of an image in the image forming apparatus 100 and allows highly accurate color matching.

Main-Scanning Shading Mode

Figure 12:
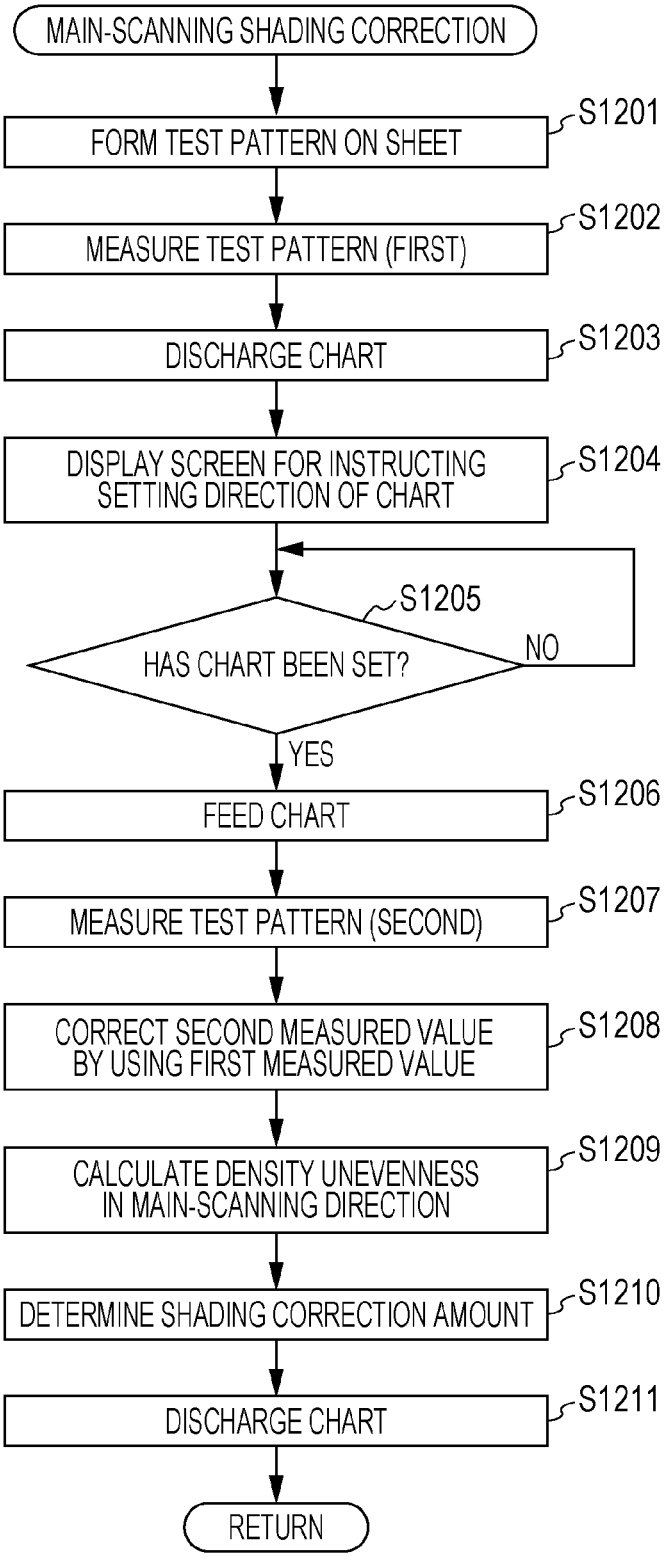
FIG. 12 is a flowchart illustrating an operation of main-scanning shading correction.

FIG. 12 is a flowchart illustrating an operation of a main-scanning shading correction. The processing on the flowchart is executed by the printer controller 103. The image forming apparatus 100 is controlled by the engine control unit 102 in response to an instruction from the printer controller 103.

An uneven color in a main scanning direction may be measured from L*a*b* data measured by using the color sensor 200 to correct the uneven color while correction of an uneven density will be described below as an example of unevenness correction.

In response to an instruction to start a main-scanning shading, the printer controller 103 instructs the engine control unit 102 to feed a sheet 110 from the container 113 and form a measurement image (hereinafter, called a test pattern) (S1201).

Figure 13:
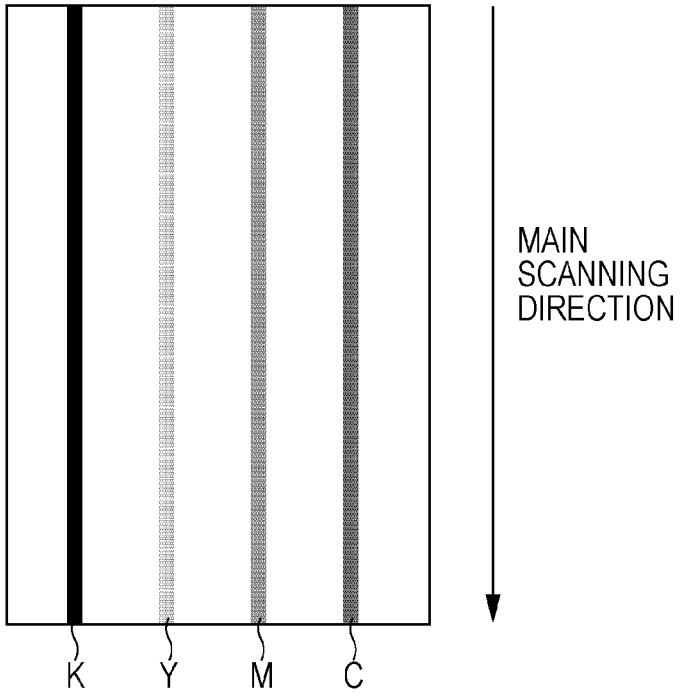
FIG. 13 illustrates details of a test pattern.

As illustrated in FIG. 13, a test pattern according to this embodiment is a band-shaped pattern extending in a main scanning direction and is formed on a sheet 110 for each of CMYK colors. The sheet size used in this embodiment is A4 (210 mm×297 mm). The width of the test pattern for each color is 10 mm in consideration of a measurement area, 5 mm, and a margin for positional deviation. The intervals between the four CMYK test patterns are equal to the intervals of the four color sensors 200*a* to 200*d*.

According to this embodiment, the test patterns are output without a margin area. For that, the writing start position of the laser 108 is adjusted to extend the width of an image formed on a drum, compared with normal image output.

According to this embodiment, the margin for normal image formation is set to 5 mm. On the other hand, for test pattern formation, a 5-mm image area is added to both sides of the A4 width (297 mm) to securely eliminate margins, resulting in a 307-mm image area in the main scanning direction. The output image density is 100%.

Because the test patterns are output without a margin area in the main scanning direction, toner may be adhered on intermediate transfer member 106 and transfer roller 114, without being transferred to the sheet 110. For that, the engine control unit 102 executes a cleaning sequence for cleaning the toner.

In the cleaning sequence, the engine control unit 102 cleans the intermediate transfer member 106 and transfer roller 114 with cleaning mechanisms 118 and 119 and at the same time controls the intermediate transfer member 106 to idly rotate one cycle.

Figure 14A:
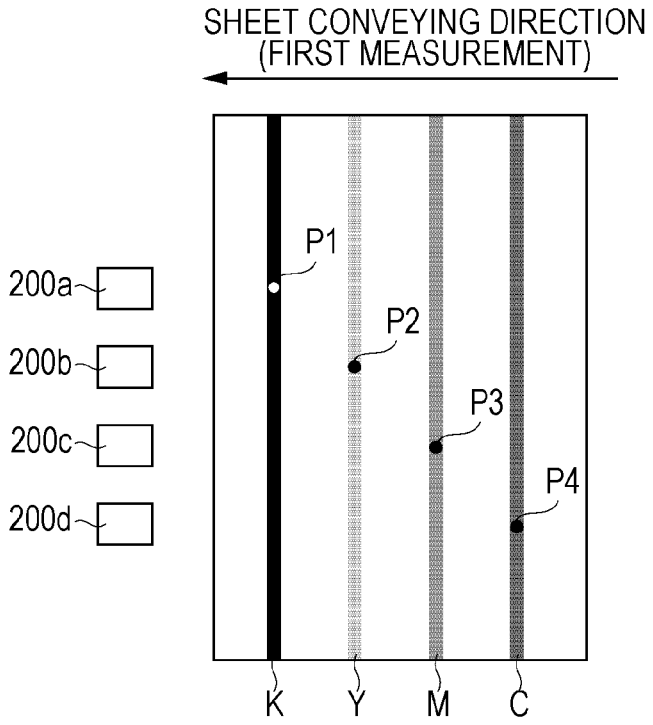
FIG. 14A illustrates a positional relationship between a chart and color sensors during a first measurement.

Next, the printer controller 103 measures the test patterns on the sheet 110 by using the color sensors 200*a* to 200*d* (S1202). The positional relationship between the sheet 110 and the color sensors 200*a* to 200*d* is illustrated in FIG. 14A.

Here, the color sensor 200*a* measure a point of measurement P1 of black (K). The color sensor 200*b* measures a point of measurement P2 of yellow (Y). The color sensor 200*c* measures a point of measurement P3 of magenta (M). The color sensor 200*d* measures a point of measurement P4 of cyan (C).

The color sensors 200*a* to 200*d* measure after a predetermined period of time from the time when the leading end of the sheet 110 is detected to measure the points of measurement P1 to P4. The printer controller 103 uses the density conversion unit 324 to convert the measurement results of the color sensors 200*a* to 200*d* to CMYK color density values and stores the color density values in the storage unit 350.

After that, the printer controller 103 instructs the engine control unit 102 to discharge the sheet 110 having the test patterns (hereinafter called a chart) to outside of the image forming apparatus 100 once (S1203).

Figure 14B:
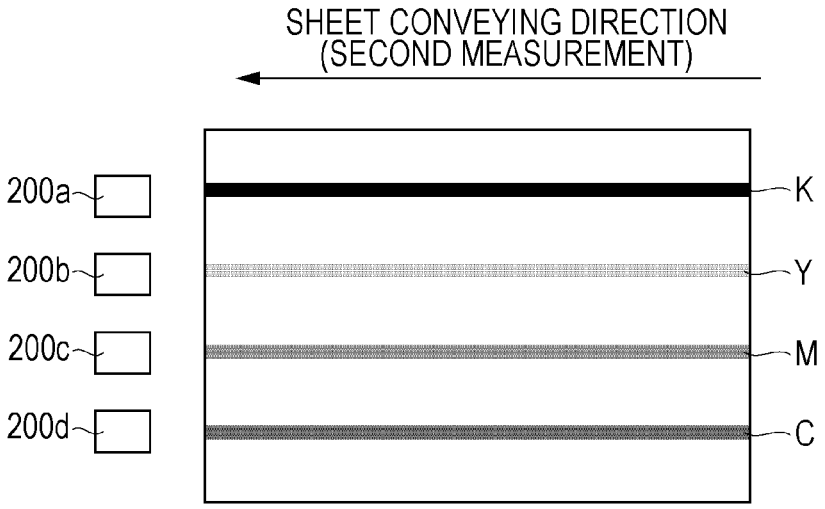
FIG. 14B illustrates a positional relationship between a chart and color sensors during a second measurement.

Because each of the test patterns is long, band-shaped in the main scanning direction, the chart may be required to rotate 90 degrees and set it in a measurement feeding unit in order to measure all areas of the test patterns with the color sensor 200. As illustrated in FIG. 14B, feeding the chart rotated 90 degrees clockwise allows measurement of CMYK test patterns with the color sensors 200*a* to 200*d*.

Figure 15:
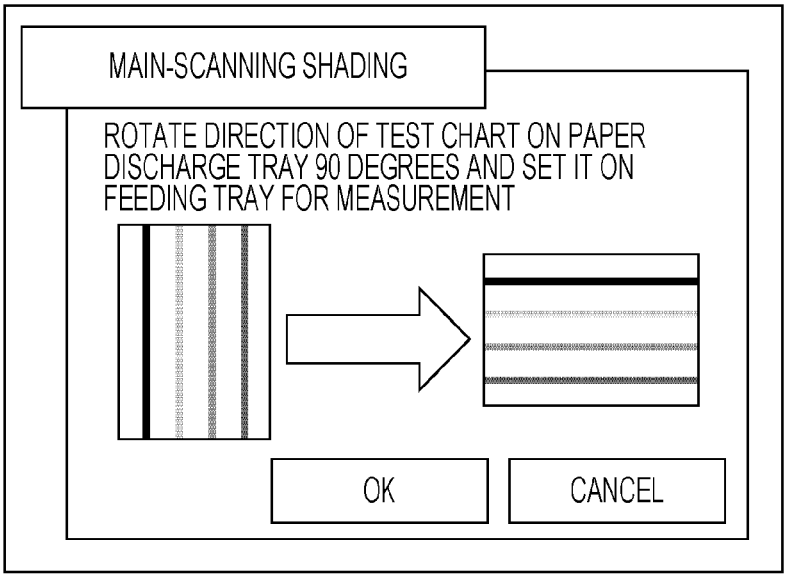
FIG. 15 illustrates a display screen for execution of main-scanning shading.

Once the discharge of the chart completes, the printer controller 103 displays a screen illustrated in FIG. 15 on the touch panel display 406 of the operating unit 180 (S1204). It should be noted that the measurement feeding unit for setting a chart may be the container 113 or a what is called manual feed tray.

Next, the printer controller 103 waits for the press of an OK key in FIG. 15, that is, the completion of the setting of the chart (S1205). When the chart setting completes, the printer controller 103 instructs the engine control unit 102 to start feeding the chart (S1206).

When the chart is fed, the printer controller 103 measures the CMYK test patterns by using the color sensors 200*a* to 200*d* (S1207). In this case, the printer controller 103 measures a plurality of points (ten points in this embodiment) in an entire area of the test pattern in the main scanning direction, unlike the first measurement. The printer controller 103 uses the density conversion unit 324 to convert the measurement results from the color sensors 200*a* to 200*d* to CMYK color density values and stores these color density values in the storage unit 350.

The points of measurements in the second measurement include the point of measurements P1 to P4 in the first measurement. In the second measurement, the printer controller 103 determines the times when the color sensors 200*a* to 200*d* reach the points of measurement on basis of the elapsed times from the times when the color sensors 200*a* to 200*d* detect the leading end of the sheet 110.

The printer controller 103 uses the measured values (from one point of measurement for each color) of the first measurement in step S1202 to correct the measured values of the second measurement in step S1207 (S1208).

Once the discharged chart is refed for a measurement, the chart again passes through the fixing unit, which changes the color density values of the test pattern. The changes in color density values are corrected in step S1208.

Figure 16:
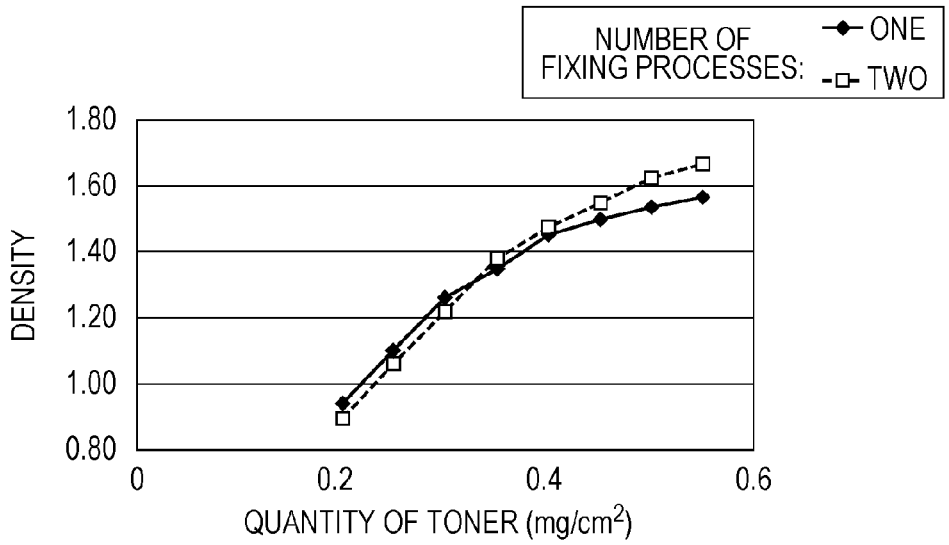
FIG. 16 illustrates how a color density value changes between first and second fixing processes.

FIG. 16 illustrates how a color density value changes between the first fixing process and the second fixing process. As illustrated in FIG. 16, the color density value after the first fixing process is higher than that after the second fixing process when the placement amount of toner is lower. On the other hand, when the placement amount of toner is as high as 0.4 mg/cm$^2$, the color density value after the second fixing process is higher than that after the first fixing process. This phenomenon will be described below.

In general, the temperature of a fixing unit is set such that a maximum quantity of toner that may be output by an engine of the image forming apparatus 100 to be used may be fixed. Thus, a lower quantity of toner may be sufficiently fixed than a higher quantity of toner.

Because a lower quantity of toner may be fixed sufficiently by the first fixing step, the second fixing step may dissolve the toner present in an upper layer of paper fiber. This may expose the paper fiber, resulting in a lower color density value.

On the other hand, while a higher quantity of toner is fixed to prevent removal of the toner from a sheet in the first fixing step, the advance of fusion of the toner is not sufficient in a lower layer of paper fiber. The second fixing step advances the toner fusion at that part and thus improves the surface nature, resulting in a higher color density value.

As a result, the measured values from the test patterns having passed through the fixing unit are different from the color density values of an image to be output by a user. According to this embodiment, the measured values of the test patterns having passed through the fixing unit twice are corrected on basis of the measured values of the test patterns having passed through the fixing unit once for highly accurate main-scanning shading. Details of the correction processing in step S1208 will be described below.

After the correction processing in step S1208, the printer controller 103 calculates uneven densities in the main scanning direction on basis of the corrected CMYK color density values (S1209). The details of the method for calculating an uneven density in a main scanning direction will be described below.

The printer controller 103 determines the amount of shading correction on basis of the uneven densities in the main scanning direction calculated by the shading correction-amount determining unit 319 (S1210). The details of the method for determining the amount of shading correction will be described below.

After that, the printer controller 103 discharges the chart (S1211), and the processing on the flowchart ends.

Method for Correcting Color Density Change Based on Difference in Number of Times of Fixing The correction method in step S1208 in FIG. 12, which is a feature of this embodiment, will be described. First, the color sensors 200*a* to 200*d* measure the points of measurement P1 to P4, respectively, in the first measurement in step S1202, as illustrated in FIG. 14A.

Next, the color sensors 200*a* to 200*d* measure entire areas of the test patterns including the points of measurement P1 to P4 in the second measurement in step S1207, as illustrated in FIG. 14B. The first measured values at the points of measurement P1 to P4 and the second measured values at the points of measurement P1 to P4 are compared, and a color density correction coefficient k is calculated for each color.

While a correction method for measuring a color density of cyan (C) test pattern by using the color sensor 200*d* will be described below, the same processing may be performed on M (magenta), Y (yellow), and K (black).

The correction coefficient k for cyan is calculated by k=D1/D2 where the first measured value at the point P1 is D1 and the second measured value at the point P1 is D2 by using the color sensor 200*d*.

In the second measurement with the color sensor 200*d*, in order to detect an uneven density in a main scanning direction, a plurality of points of measurement are set in the entire area of the test patterns in the main scanning direction. The measured values at the points of measurement are multiplied by the correction coefficient k to correct a change in color density value due to the second fixing step.

Uneven-Density Calculation Method and Amount of Shading Correction Determination Method Next, the uneven density calculation method in step S1209 in FIG. 12 and the amount of shading correction determination method in step S1210 will be described.

Figure 17:
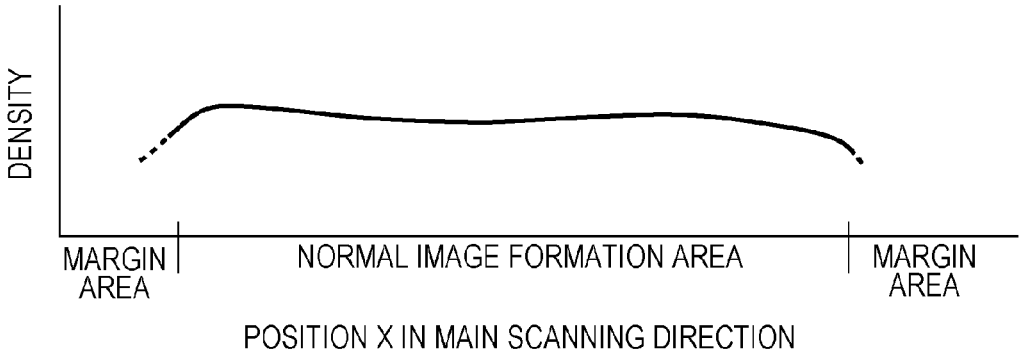
FIG. 17 illustrates a color density distribution in a main scanning direction of a test pattern.

FIG. 17 illustrates a color density distribution, which is corrected in step S1207, of the test pattern in the main scanning direction. In this example, the distribution is based on measurement results of the C (cyan) test pattern. The horizontal axis indicates the position X in the main scanning direction, and the vertical axis indicates optical color density. As described above, the test pattern has a color density of 100%.

While C (cyan) will be described here, for example, the same processing may be performed on M (magenta), Y (yellow), and K (black).

As the correction method, there have been known a method of changing the degree of pulse width modulation (PWM) of the laser 108 in accordance with the position in a main scanning direction or laser 108 and a method of changing the intensity of radiated light in accordance with the position in a main scanning direction. While the two methods will be described, the correction method is not limited to the two methods.

(1) Correction of PWM of Laser 108

When the degree of PWM of the laser 108 is to be corrected, the degree of modulation after the correction may be calculated by the following equation:

$$M'PWM=MPWM\times\beta(x)$$

where

M'PWM: the degree of modulation after a correction

MPWM: the degree of modulation before the correction $\beta(x)$: a correction coefficient in a main scanning direction x: a position in the main scanning direction How the correction coefficient $\beta(x)$ in a main scanning direction is calculated will be described below. The printer controller 103 calculates the ratio of color density $\alpha(x)$ by the following equation:

$$\alpha(x)=D\min/D(x)$$

where the color density value of the lowest color density is Dmin and the color density value at a position X in the main scanning direction is D(x) in a color density distribution within a normal image formation area illustrated in FIG. 17, for example.

Figure 18A:
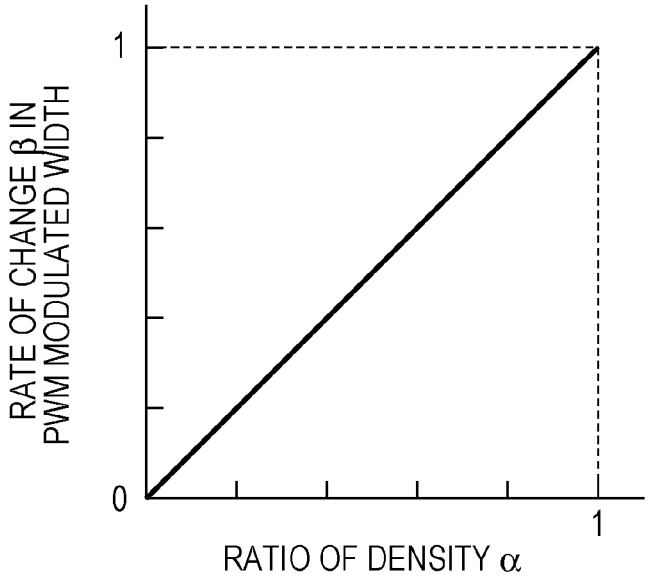
FIG. 18A illustrates a relationship between a ratio of color density $\alpha(x)$ and a correction coefficient $\gamma(x)$ in a main scanning direction.

The printer controller 103 converts the ratio of color density $\alpha(x)$ to the correction coefficient $\beta(x)$ in the main scanning direction on basis of a relationship (FIG. 18A) between the ratio of color density $\alpha(x)$ and the correction coefficient $\beta(x)$ in the main scanning direction. The relationship between $\alpha(x)$ and $\beta(x)$ illustrated in FIG. 18A is pre-stored in the storage unit 350 in an equation form, a table form, or the like. The correction coefficient for a part between measurement positions of a test pattern is acquired by an interpolation calculation.

In this way, the printer controller 103 may acquire the degree of modulation M'PWM after a correction, modulate exposure light such that the degree of modulation may be equal to M'PWM, and may correct an uneven density in a main scanning direction.

(2) Correction of Intensity of Light Radiated by Laser 108

The intensity of light radiated by the laser 108 may be corrected, instead of correction of a degree of modulation of PWM by the laser 108. Correction of an intensity of light irradiated by the laser 108 will be described. In this case, the intensity of radiated light after a correction may be acquired by the following equation:

$$P'=P\times\gamma(x)$$

where

P': the intensity of irradiated light after a correction;

P: the intensity of irradiated light before the correction;

$\gamma(x)$: a correction coefficient in a main scanning direction; and x: a position in the main scanning direction How the correction coefficient $\gamma(x)$ in a main scanning direction is calculated will be described below. The printer controller 103 calculates the ratio of color density $\alpha(x)$ by the following equation:

$$\alpha(x)=D\min/D(x)$$

where the color density value of the lowest color density is Dmin and the color density value at a position X in the main scanning direction is D(x) in a color density distribution within a normal image formation area illustrated in FIG. 17, for example.

Figure 18B:
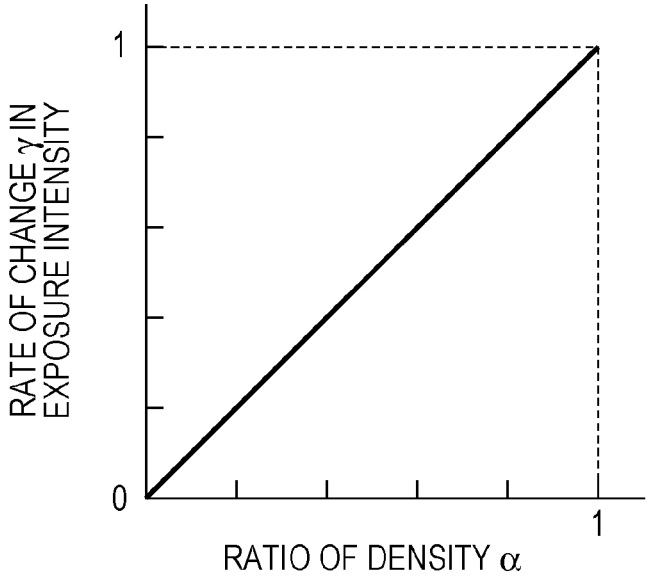
FIG. 18B illustrates a relationship between a ratio of color density $\alpha(x)$ and a correction coefficient $\gamma(x)$ in a main scanning direction.

The printer controller 103 converts the ratio of color density $\alpha(x)$ to the correction coefficient $\gamma(x)$ in the main scanning direction on basis of a relationship (FIG. 18B) between the ratio of color density $\alpha(x)$ and the correction coefficient $\gamma(x)$ in the main scanning direction. The relationship between $\alpha(x)$ and $\gamma(x)$ illustrated in FIG. 18B is pre-stored in the storage unit 350 in an equation form, a table form, or the like. The correction coefficient for a part between measurement positions of a test pattern is acquired by an interpolation calculation.

In this way, the printer controller 103 may acquire the intensity of light P' irradiated by the laser 108 after a correction and correct the intensity of irradiated light to P' to correction an uneven density in the main scanning direction.

For maximum-density adjustment, tone adjustment, and multinary color correction processing, a correction result of a main-scanning shading correction may be used to form a patch image with an uneven density corrected.

As described above, this embodiment may not require a special conveying path which prevents a chart from passing through a fixing unit twice. Thus, according to this embodiment, an uneven density in a main scanning direction of an image to be formed may be corrected with high accuracy without increasing the size of the image forming apparatus 100.

Second Embodiment

According to the first embodiment, a measured value from the first test pattern is used to correct a measured value from the second test pattern. On the other hand, according to a second embodiment, a test pattern may be measured only once after a chart is refed, and a conversion table prestored in the storage unit 350 may be used to convert the measured value. The other processing is performed as in the first embodiment.

FIG. 19 illustrates a conversion table used in the second embodiment. For example, when the color density value measured after a chart is refed (color density value after the second fixing) is equal to 0.454, the color density value is converted to 0.544 that is a color density value after the first fixing. In this manner, the color density value after the second fixing which is measured by the color sensor 200 is converted to a color density value after the first fixing.

If the color density value measured aster a chart is refed (color density value after the second fixing) does not exist on the conversion table, a linear interpolation is performed between the previous and subsequent values. For example, when the color density value measured after a chart is refed is equal to 1.0, the linear interpolation is performed between 0.886 and 1.068 that are color density values after the second fixing in FIG. 19, and a linear interpolation is performed between 0.943 and 1.105 that are color density values after the first fixing among the color density values after the first fixing.

More specifically, the measured color density value 1.0 is converted to 1.044 on basis of an interpolation equation of:

$$D1=0.890D2+0.154$$

where D1 is a color density value after the first fixing and D2 is a color density value after the second fixing.

Also according to this embodiment, an uneven density in a main scanning direction of an image to be formed may be corrected with high accuracy without increasing the size of the image forming apparatus 100, like the first embodiment.

Having described correction of an uneven density, an uneven color in a main scanning direction may be measured from the L*a*b* data measured by using the color sensor 200, and the uneven color may be corrected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-043233, filed Mar. 5, 2013, which is hereby incorporated by reference herein in its entirety.

What is claimed is:

1. An image forming apparatus comprising:

a conveying unit configured to convey a sheet;

an image forming unit configured to form a measurement image on a sheet along a main scanning direction orthogonal to a sheet conveying direction of the conveying unit;

a fixing unit configured to fix the measurement image formed by the image forming unit onto the sheet by heating;

a measuring unit configured to irradiate light to the measurement image on the sheet having passed through the fixing unit, measuring reflected light from the measurement image, and outputting a measured value;

a discharging unit configured to discharge a sheet measured by the measuring unit;

a feeding unit configured to rotate the direction of a sheet discharged by the discharging unit once such that the measurement image formed along the main scanning direction is along the sheet conveying direction;

a first calculation unit configured to cause the measuring unit to output a measured value at a predetermined point of measurement on the measurement image after the sheet passes through the fixing unit, cause the feeding unit to feed the sheet, causing the sheet to pass through the fixing unit again, cause the measuring unit to output measured values at a plurality of points of measurement including the measured value at the point of measurement, and calculate a first correction coefficient from a first measured value and a second measured value at the point of measurement;

a correction unit configured to correct the measured values at the plurality of points of measurement by using the first correction coefficient calculated by the first calculation unit; and a second calculation unit configured to calculate a second correction coefficient for correcting an unevenness in the main scanning direction on basis of the measured value at the plurality of points of measurement corrected by the correction unit.

2. The image forming apparatus according to claim 1, wherein the first calculation unit calculates a first correction coefficient k by using an equation of k=D1/D2 wherein the first measured value is D1 and the second measured value is D2.

3. The image forming apparatus according to claim 2, wherein the correction unit multiplies measured values at the plurality of points in the second measurement by the correction coefficient k to correct the measured values at the plurality of points.

4. The image forming apparatus according to claim 1, wherein the image forming unit forms the measurement image such that the size of the measurement image in the main scanning direction is larger than the size in the main scanning direction of the sheet.

5. The image forming apparatus according to claim 4, further comprising a cleaning unit configured to clean a part of the measurement image running off the sheet when the image forming unit forms the measurement image.

6. The image forming apparatus according to claim 1, further comprising a display unit configured to display a sheet on which the measurement image is formed by the image forming unit such that the sheet rotated 90 degrees is set in the feeding unit.

7. The image forming apparatus according to claim 1, wherein the measuring unit disperses the reflected light in accordance with its wavelength and receives and measures the dispersed light.

8. The image forming apparatus according to claim 1, wherein the unevenness is an uneven density of an image in the main scanning direction.

9. The image forming apparatus according to claim 1, wherein the unevenness is an uneven color of an image in the main scanning direction.

10. The image forming apparatus according to claim 1, wherein the measurement image is a band-shaped pattern extending in the main scanning direction.

11. The image forming apparatus according to claim 1, wherein the image forming unit exposes a photosensitive drum having a charged surface in the main scanning direction to form an electrostatic latent image and develops the electrostatic latent image with toner to form the measurement image.

12. The image forming apparatus according to claim 11, wherein the second correction unit changes the degree of pulse width modulation in accordance with the position in the main scanning direction of light for exposing the photosensitive drum to correct an unevenness of an image in the main scanning direction.

13. The image forming apparatus according to claim 11, the second correction unit changes the intensity of light for exposure of the photosensitive drum in accordance with its position in the main scanning direction to correct an unevenness of an image in the main scanning direction.

14. The image forming apparatus according to claim 1, wherein: the measurement image is a multinary color image formed with coloring materials of a plurality of colors; and the measuring unit measures a color of the measurement image.

15. The image forming apparatus according to claim 1, wherein the measuring unit irradiates light to the measurement image, disperses the reflected light from the measurement image in accordance with its wavelength, and measures the dispersed light to measure a color of the measurement image.

16. The image forming apparatus according to claim 1, wherein the image forming unit is a unit configured to transfer toner to the sheet to form the image.

17. The image forming apparatus according to claim 1, wherein the image forming unit is a unit configured to eject ink to form the image on the sheet.

18. An image forming apparatus comprising:

a conveying unit configured to convey a sheet;

an image forming unit configured to form a measurement image on a sheet along a main scanning direction orthogonal to a sheet conveying direction of the conveying unit;

a fixing unit configured to fix the measurement image formed by the image forming unit onto the sheet by heating; an discharging unit configured to discharge a sheet heated by the fixing unit;

a feeding unit configured to rotate the direction of a sheet discharged by the discharging unit once such that the measurement image formed along the main scanning direction is along the sheet conveying direction;

a measuring unit configured to irradiate light to the measurement image on the sheet refed by the feeding unit and having passed through the fixing unit again, measuring reflected light from the measurement image, and outputting a measured value;

a converting unit configured to convert a measured value from the sheet passed through the fixing unit twice and output from the measuring unit to the measured value from the sheet having passed through the fixing unit once; and a calculation unit configured to calculate a correction coefficient for correcting an unevenness of an image in the main scanning direction on basis of the measured value converted by the converting unit.

* * * * *